United States Patent [19]

Webster

[11] 4,133,613

[45] Jan. 9, 1979

[54] PRINTER PAPER FEEDER

[75] Inventor: Lyle B. Webster, Port Washington, N.Y.

[73] Assignee: Harris Corporation, Cleveland, Ohio

[21] Appl. No.: 881,059

[22] Filed: Feb. 24, 1978

Related U.S. Application Data

[63] Continuation of Ser. No. 711,598, Aug. 4, 1976, abandoned.

[51] Int. Cl.[2] ..... B41J 11/27; B41J 11/70

[52] U.S. Cl. ..... 400/616.3; 400/621

[58] Field of Search ..... 226/76; 400/616, 616.3, 400/621, 621.2

[56] References Cited

U.S. PATENT DOCUMENTS

| | | | |
|---|---|---|---|
| 1,431,266 | 10/1922 | Sherman | 400/616.3 X |
| 2,241,357 | 5/1941 | Paschke | 400/621 |
| 2,402,074 | 6/1946 | Nield | 226/81 X |
| 2,943,721 | 7/1960 | Salmon et al. | 400/616.3 |
| 3,587,811 | 6/1971 | Smith et al. | 400/569 |

*Primary Examiner*—Paul T. Sewell

[57] ABSTRACT

Apparatus for feeding sheet material past a printing station. A cylindrical platen is included having circumferentially arranged guide pins which cooperate with corresponding perforations along the edges of the sheet material to provide positive feeding and accurate alignment of the sheet material. The printing station is disposed immediately adjacent the platen and serves to imprint the desired information on the sheet material. The guide pins, which would otherwise interfere with the operation of the printing station, are retracted into the platen when passing the printing station during the rotation of the platen. In a preferred embodiment, this goal is accomplished by rotating the platen about a fixed, coaxially disposed cam. The pins are radially spring biased against the cam so that the amount of radial extension of each of the pins from the outer surface of platen is determined by the surface contour of the cam. The cam is structured to cause the extension of each pin during most of the rotation of the platen, but to allow retraction thereof during the portion of the rotation in which that pin passes the printing station.

1 Claim, 3 Drawing Figures

FIG. 1
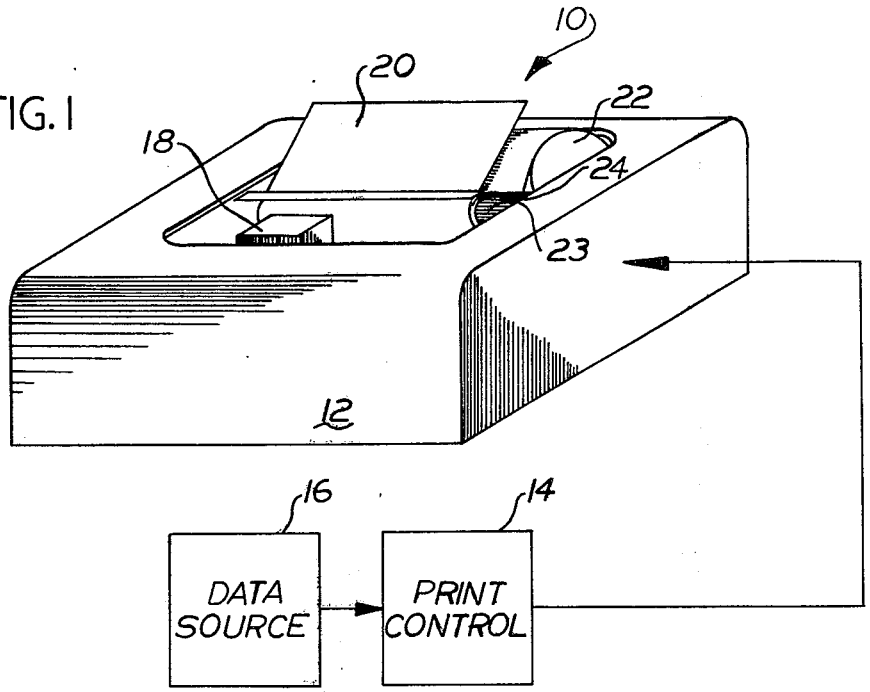
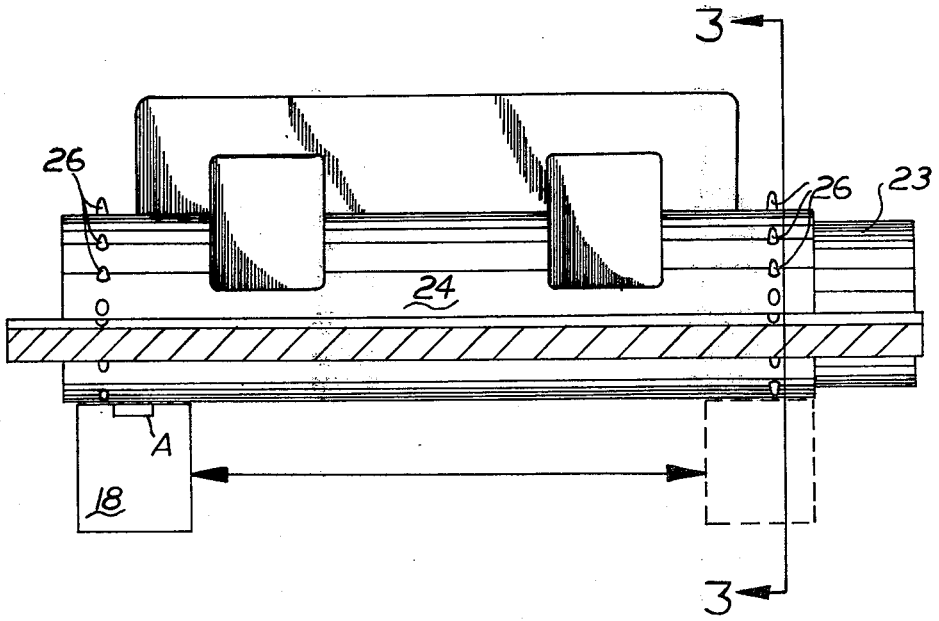
FIG. 2

PRINTER PAPER FEEDER

This is a continuation of application Ser. No. 711,598 filed Aug. 4, 1976 now abandoned.

BACKGROUND AND FIELD OF THE INVENTION

The present invention relates to devices for recording information on sheet material, and more particularly to sheet advance platens having alignment pins which are retractable during some portion of the rotation of the platen.

Cylindrical printing platens are widely used in such applications as computer print-out devices, teletype machines, typewriter, etc. It has been recognized that positive advance and accurate alignment of the sheet material can be realized by providing these platens with circumferentially disposed sheet alignment pins. These alignment pins can be particularly useful in applications requiring close registry of multiple sheets, or where pre-printed sheet forms must be precisely positioned during the printing operation.

Since these pins extend beyond the outer surface of the platen, they tend to interfere with the operation of the printing head for at least a portion of its motion across the platen. This results in a corresponding limitation in the width of paper upon which information may be recorded. More efficient use may be made of the full width of the paper if the pins are deleted, however the advantages inherent in the use of alignment pins is then lost.

It is therefore an object of the present invention to provide information recording apparatus which includes a platen having alignment pins and which yet retains the advantages of platens not having such pins.

It is another object of the present invention to provide a printing platen for use with the printing station and which has alignment pins circumferentially disposed thereon which are retracted during travel past the recording station so as to prevent interference therewith.

It is yet another object of the present invention to provide printing apparatus which provides positive advance of the sheet material and also allows use of a relatively wide printing field.

In accordance with the present invention, recording apparatus is provided including a platen having a plurality of alignment pins disposed thereon for engaging corresponding perforations in the sheet material to be printed upon. A recording station is disposed adjacent the platen for imparting information to the sheet material. Means are included for rotating the platen so as to feed the material past the recording station. Further means are provided for retracting each of the pins during that portion of the rotation of the platen when that pin is passing the recording station.

BRIEF DESCRIPTION OF THE DRAWINGS

The foregoing and other objects and advantages of the present invention will become more readily apparent from the following description of the preferred embodiment as taken in conjunction with the accompanying drawings which are a part hereof and wherein:

FIG. 1 is a diagram of a printing system in which the present invention may be employed;

FIG. 2 is a plan view of the platen and recording station sections of the recording system in FIG. 1; and, FIG. 3 is a sectional view of the platen, taken along lines 3—3 of FIG. 2.

DETAILED DESCRIPTION

Figure 3:
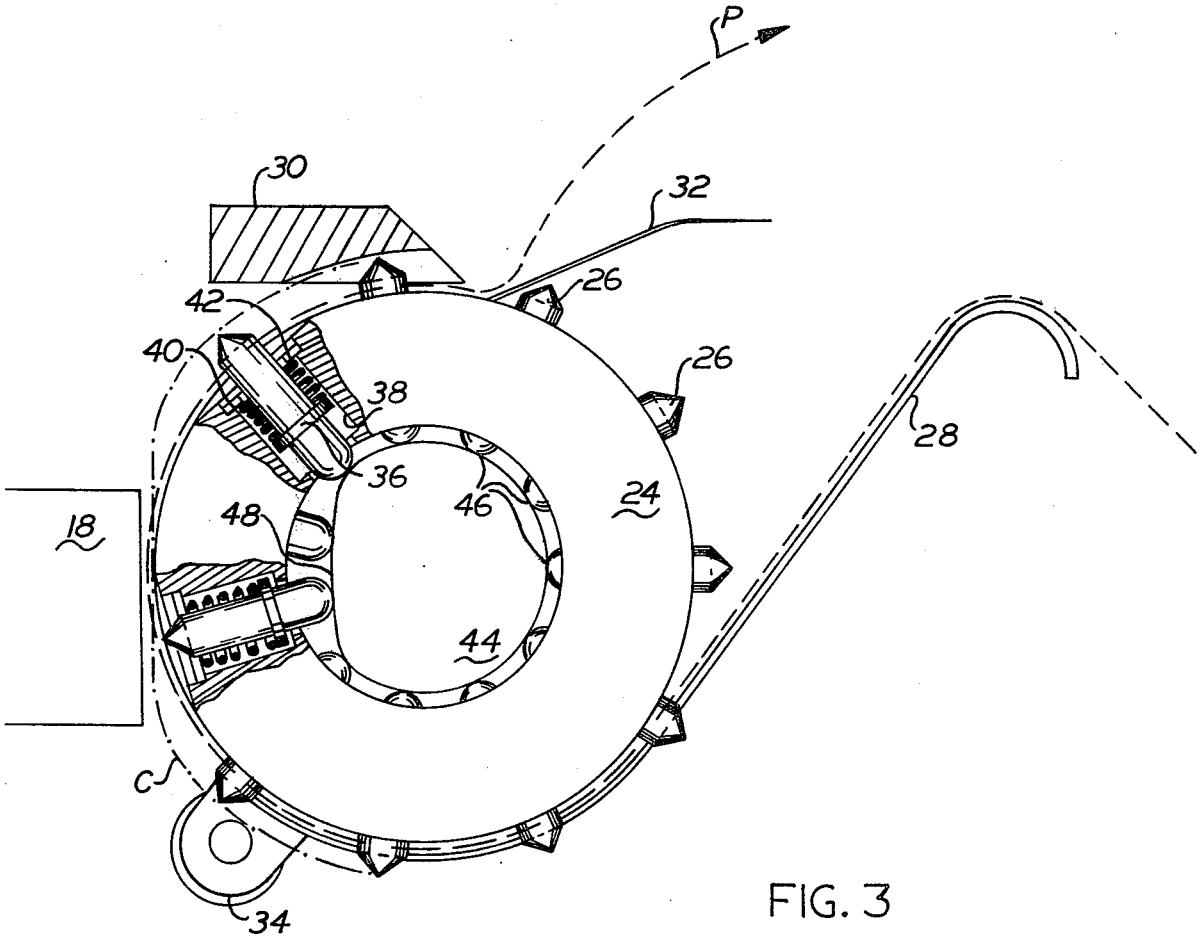

FIG. 1 is included purely for the purpose of exemplifying the applications in which the present invention may find maximum utility. The general aspects of this system and other similar systems are well known in the art and form no part of the invention.

Referring now to FIG. 1, there is shown a recording system, generally indicated by numeral 10. A printing device 12 is controlled by print control apparatus 14 which is, in turn, controlled by data source 16. Printing device 12 has a recording station 18 which responds to signals supplied by print control apparatus 14 to impart corresponding symbols to sheet material 20 supplied by roll 22. Recording station 18 may, for example, be an impact printing head. Platen ratchet drive 23 advances sheet material 20 by controllably rotating a printing platen 24 upon command by print control apparatus 14.

FIG. 2 is a plan view of certain elements of printing device 12 and is included for showing the relation of the recording station 18 to platen 24. Platen 24 has a plurality of pins 26 circumferentially spaced around each end thereof. These pins engage corresponding perforations along the edges of sheet material 20 so as to provide positive feeding thereof. Printing device 12 includes means for moving recording station 18 from the shown position, leftward of platen 24, to the position indicated by the dotted lines, rightward of platen 24.

The actual printing function will generally be performed at a position midway along the face of recording station 18. This position is identified in FIG. 2 by the letter A. It will be noted that printing head 18 has a width that is much greater than the width of printing area A. In prior art devices, the left- or rightward extension of printing head 18 was limited by the protrusion of pins 26. Since the printing head 18 must lie quite close to platen 24, the left- or rightward edge of printing head 18 would come in contact with pins 26 at the extremes of the left- or rightward movement thereof. Since the printing area A is some distance from the edge of printing head 18, the nearness with which the printed characters could be placed to the edge of the sheet material was limited by the extension of pins 26 and the width of printing head 18. As will be described in greater detail hereinafter, the present invention comtemplates retracting each of the pins at the appropriate moment to prevent interference with the operation of recording station 18.

The path of the paper about platen 24 is indicated in FIG. 3 by the dash line identified by letter P. The paper passes over a paper scoop 28, around platen 24, past printer head 18 and tear-off knife 30, and is ejected by a blade spring 32. A roller 34 presses the paper lightly against platen 24.

In a preferred embodiment, eleven radially disposed pins 26 are provided at equally spaced circumferential positions about platen 24. Each pin is generally cylindrical in shape, having an integral annular ring 36 of slightly greater diameter. Each pin is confined within a generally cylindrical, radially oriented bore 38 by a retaining ring 40. Retaining ring 40 has an opening therein through which the smaller diameter portion of the pin can feely pass. Each pin 26 also has a corresponding coaxially disposed coil spring 42 confined on the one hand by annular ring 36 and on the other hand by retaining ring 40. Coil spring 42 serves to bias the pin in a generally radial direction against a fixed cam 44. Platen 24 is coaxially disposed about fixed cam 44 and rotated thereabout so that the inward ends 46 and guide pins 26 follow the outward surface of fixed cam 44. Fixed cam 44 is structured so that pins 26 extend above the outer edge of platen 24 throughout the majority of the rotation thereof. However, during the portion of rotation when pins 26 pass printing station 18, the pins are allowed to retract within platen 24 so as to not interfere with the operation of printing station 18. As shown in FIG. 3, this can be accomplished by providing cam 44 with a generally circular cross section, but with a flattened portion 48 adjacent printing station 18. When so constructed, the tips of pins 26 will follow the path indicated by the broken line C.

A printing platen has thus been described in which guide pins circumferentially arranged about each edge of the platen are retracted during the portion of rotation when their extension would interfere with the operation of the printing station. Although the described embodiment utilizes a fixed cam for accomplishing the extension and retraction of the guide pins, it will be appreciated that various other embodiments may be employed for accomplishing substantially the same effect. Thus, although the present invention has been described with respect to a preferred embodiment, it will be appreciated that various alterations and arrangement of parts may be made without departing from the spirit and scope of the invention as defined by the appended claims.

What is claimed is:

1. Apparatus for imparting information to sheet material provided with feed holes arranged along two lines respectively extending parallel to and in close proximity with the left- and rightward margins of said sheet material, comprising: a generally cylindrical platen about which said sheet material is to be disposed, said platen being rotatably driven about the cylindrical axis thereof by drive means and having a plurality of radially extending feeder pins disposed at spaced circumferential positions thereabout and at two axial positions along said platen, said axial and circumferential positions of said pins being selected so that each of said pins will be received by a corresponding said feed hole of said sheet material when said sheet material is disposed thereabout, said feeder pins being radially moveable between a normal extended position wherein said pins protrude outward from said platen and positively engage said feed holes and a retracted position wherein said pins are substantially received within said platen; a recording station disposed at a first fixed circumferential position adjacent said platen and axially moveable between a range of axial positions, including the axial positions occupied by said pins, for imparting information to said sheet material; a sheet material cutoff bar extending axially along and adjacent to said platen at a second fixed circumferential position, said sheet material cutoff bar being spaced apart from said platen by a distance which is smaller than the distance by which said feeder pins extend from said platen when in said normal extended position, but having notches therein to allow passage of said feeder pins therepast when said feeder pins are in said extended position, said sheet material being arranged to pass between said sheet material cutoff bar and said platen; drive means operatively associated with said platen for rotating said platen in a first direction about its axis so as to drive said sheet material first past said recording station and then past said sheet material cutoff bar; and, retracting means for placing each of said feeder pins in said retracted position only when said pin is passing said recording station and for otherwise placing said pins in said normal extended position so that said pins are retracted when passing said recording station and do not interfere with the operation of said recording station but are extended when passing said sheet material cutoff bar so that said sheet material is positively engaged by said feeder pins through the cooperation of said feeder pins with said sheet material cutoff bar, and is thus positively driven beyond said recording station and past said sheet material cutoff bar.

* * * * *